United States Patent [19]

Hale

[11] Patent Number: 4,766,712

[45] Date of Patent: Aug. 30, 1988

[54] SPACE FRAMING SYSTEM

[76] Inventor: Whitney M. Hale, 2012 N. Normal Ave., Tempe, Ariz. 85281

[21] Appl. No.: 416,126

[22] Filed: Sep. 9, 1982

[51] Int. Cl.[4] ..... E04H 12/06; F16D 1/00

[52] U.S. Cl. ..... 52/645; 52/648; 403/171; 403/176; 403/231

[58] Field of Search ..... 52/93, 645, 655, 81, 52/648; 403/169–173, 174–176, 177, 178, 187, 189, 231, 292, 295, 296, 405, 406, 407; 46/29, 26

[56] References Cited

U.S. PATENT DOCUMENTS

| | | | |
|---|---|---|---|
| 2,371,493 | 3/1945 | Aschinger . | |
| 2,869,237 | 1/1959 | Berge | 403/169 |
| 3,195,266 | 7/1965 | Onanian | 46/29 X |
| 3,255,721 | 6/1966 | Peterschmidt | 108/111 |
| 3,327,380 | 6/1967 | Howlett | 403/187 X |
| 3,510,979 | 5/1970 | Fischer | 46/26 X |
| 3,600,825 | 8/1971 | Pearce | 35/18 A |
| 3,648,404 | 3/1972 | Ogsbury . | |
| 3,747,261 | 7/1973 | Salem . | |
| 3,822,499 | 7/1974 | De Vos | 46/26 |
| 3,864,051 | 2/1975 | Reid | 403/173 |
| 3,921,360 | 11/1975 | Baldwin | 52/648 |
| 3,936,111 | 2/1976 | Mazzucconi | 403/173 |
| 3,982,841 | 9/1976 | Endzweig | 403/19 |
| 4,012,153 | 3/1977 | Pidgeon | 403/170 |
| 4,318,629 | 3/1982 | Yamamoto | 403/176 |
| 4,324,083 | 4/1982 | Johnson, Jr. | 52/648 |

FOREIGN PATENT DOCUMENTS

| | | | |
|---|---|---|---|
| 2815243 | 11/1979 | Fed. Rep. of Germany | 403/170 |
| 1391973 | 2/1965 | France | 403/171 |
| 1582664 | 1/1981 | United Kingdom | 403/231 |
| 2082668 | 3/1982 | United Kingdom | 403/407 |

OTHER PUBLICATIONS

"Developments in Canada in the Fabrication and Construction of Three-Dimensional Structures Using the Triodetic System"; H. G. Fentiman, Triodetic Structures Limited, Ottawa, Ontario, Canada, pp. 1073–1082.

"Space Grid Structures"; John Barrego, the MIT Press, copyrighted 1968.

*Primary Examiner*—John E. Murtagh

*Attorney, Agent, or Firm*—Warren F. B. Lindsley

[57] ABSTRACT

A framing system for interconnecting elongated frame members into structurally stable, free-standing frames, building frame modules, lattice-type framework and the like employing novel connectors and associated connector arms.

6 Claims, 6 Drawing Sheets

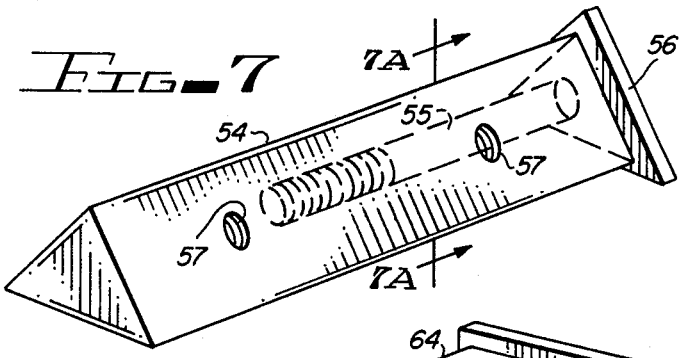
FIG. 7
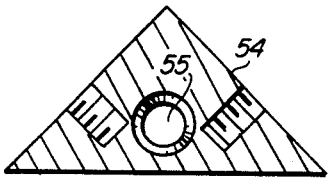
FIG. 7A
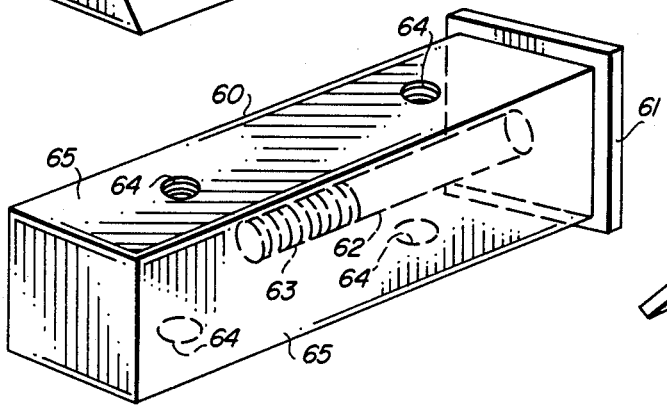
FIG. 8
FIG. 9
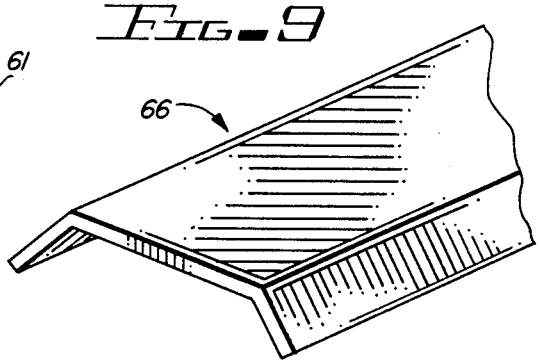
FIG. 10
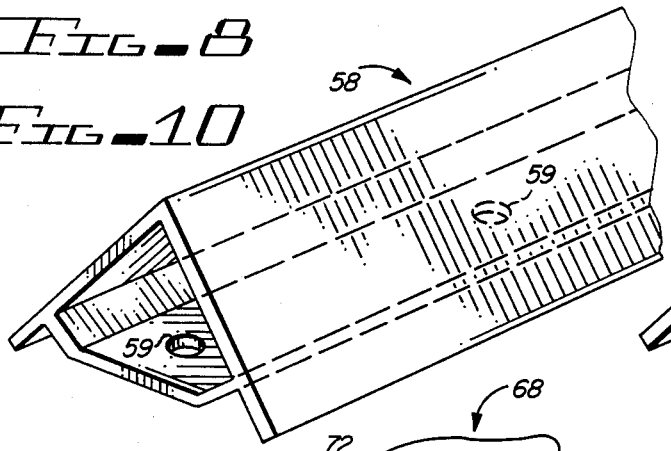
FIG. 11
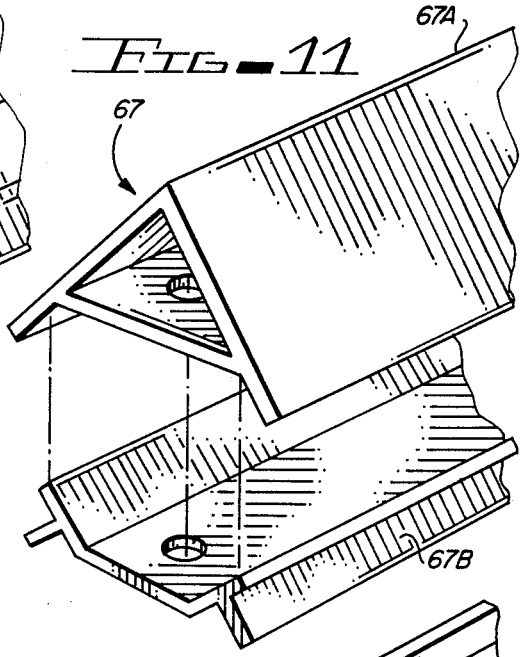
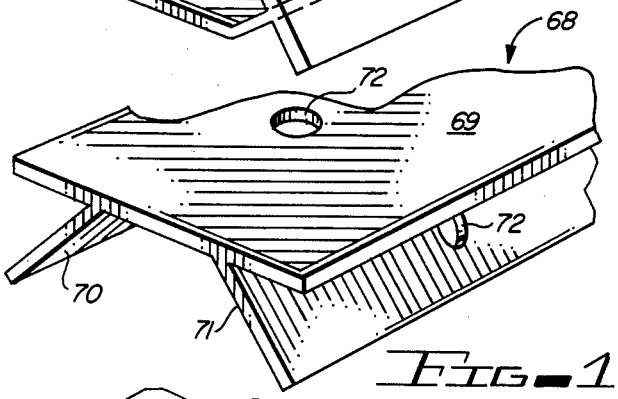
FIG. 12
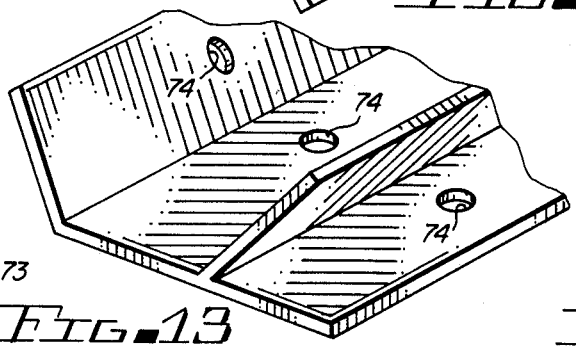
FIG. 13
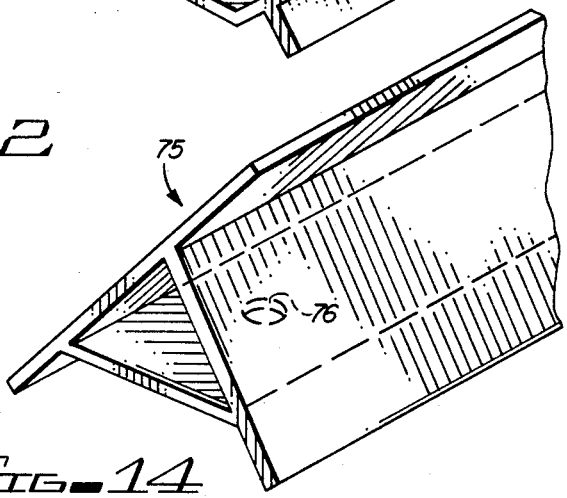
FIG. 14

SPACE FRAMING SYSTEM

BACKGROUND OF THE INVENTION

This invention relates to framing systems and, more particularly, to connectors for interconnecting elongated frame members into structurally stable, freestanding frames, building frame modules, lattice-type framework and the like.

Space structures may be defined as two and three-dimensional assemblies of elements resisting loads which can be applied at any point, inclined at any angle to the surface of the structure and acting in any direction. These structures can be built up economically from simple prefabricated units, in most cases of standard size and shape. Such units, mass produced in the factory, can be easily and rapidly assembled on site by semi-skilled labor. At the same time, the small size of the units simplifies greatly the problems of handling and transportation.

Many things influenced the rapid recent development of space frames, including the reduction in the complexity of analysis of such systems and in the joining of several members in space at different angles. These difficulties have been overcome by several present day connectors produced mainly for prefabricated steel or aluminum structures. Through mass production, their cost has been reduced and their use enables the erection of highly complex space structures by semi-skilled personnel.

A connector is the most important part of any prefabricated system and the final commercial success relies directly on its effectiveness and simplicity. Many different types of connectors have been proposed for space structures; some of them have been used in practice, but only a few have survived the test of time.

Heretofore, designers have tried to produce a universal connector suitable for many types of structures, but have ended up with an unnecessarily complex connector consisting of too many parts.

Thus, a need exists for a connector and the resulting framing structure which has the advantage of flexibility in use, yet is simple to manufacture and easy to use by semi-skilled personnel.

DESCRIPTION OF THE PRIOR ART

The Triodetic Structures Limited of Ottawa, Ontario, Canada, developed a joint for connecting space structures involving the cold forming of the ends of structural members to produce a key and an extruded or formed hub connection into which the members fit.

The MERO-TRIGONAL system of Dr. Ihg Max Mengeringhauser discloses in an article entitled Space Grid Structures, by John Barrego, The MIT Press, copyrighted 1968, a threaded steel ball which enables up to eight members to be connected to any of the three planes at angles of 45 degrees.

U.S. Pat. No. 3,921,360 discloses a connector for a framework-type structure having the shape of an irregular polyhedron.

U.S. Pat. No. 3,255,721 discloses a joint which will receive structural members at several mutually perpendicular angles.

U.S. Pat. No. 2,371,493 discloses a metallic splice member having angularly extending arms, each of which has a dovetail cross-sectional formation received within correspondingly formed slots provided in the adjacent ends of angularly extending frame bars.

U.S. Pat. No. 3,747,261 discloses a ball and socket linkage for polyhedral members utilizing a connector in the shape of a cube to receive the ball-shaped member.

U.S. Pat. No. 3,982,841 discloses a connector 20 having slots which limit the movement of the structural members.

U.S. Pat. No. 3,648,404 discloses a ball and socket connector with the balls on the connector rather than on the structural member.

U.S. Pat. No. 3,600,825 discloses triangular framing members.

SUMMARY OF THE INVENTION

In accordance with the invention claimed, a new and improved space framing system and connectors therefor are provided for the erection of supporting lattice-type frameworks for buildings, furnishing for the building, shelving and the like comprising elongated structural members or struts which can be joined to one another by novel connectors to form the desired shape framework. The struts and the connectors may be fabricated off site and transported to and assembled at the sites where the framework is to be erected.

It is, therefore, one object of this invention to provide a new and improved structural framework.

Another object of this invention is to provide a new and improved lattice-type support structure for buildings and the like, which component parts may be economically fabricated at a location remote from the building site and then quickly and economically transported to and assembled at the building site.

A further object of this invention is to provide new and improved connectors for coupling the elongated structural members or struts forming a lattice-type framework which assures the structural stability of the framework, enables the use of struts of identical or different lengths, and avoids the necessity of bending or otherwise distorting the struts to effect the final assembly.

A still further object of this invention is to provide a new and improved connector arm that is removably attached to an end of an elongated structural member and adapted to engage and be firmly held by an appropriately sized aperture located in a connector.

A still further object of this invention is to provide a new and improved connector assembly that is removably inserted into the end of an elongated, tubular frame member to form a connection therewith.

A still further object of this invention is to provide a new and improved framing system which can be erected by semi-skilled labor.

A still further object of this invention is to provide a new and improved framing system which may have three or more panels intersecting along a central axis to operate in a fixed, hinged or sliding arrangement at any angle while independent of the other panels.

Further objects and advantages of the invention will become apparent as the following description proceeds; and the features of novelty which characterize this invention will be pointed out with particularity in the claims annexed to and forming part of this specification.

BRIEF DESCRIPTION OF THE DRAWINGS

This invention may be more readily described by reference to the drawings, in which:

FIG. 7 is a perspective view of a modification of a male extension plug formed in a triangular bar configuration;

FIG. 7A is a cross-sectional view of FIG. 7 taken along the line 7A—7A;

FIG. 8 is a perspective view of a further modification of the male extension plug shown in FIG. 7;

FIGS. 9–14 are partial perspective views of further modifications of the tubular frame members shown in FIGS. 1, 2, 6 and 29;

FIGS. 23–28 are cross-sectional views of various modifications of tubular frame members;

DESCRIPTION OF THE PREFERRED EMBODIMENT

Figure 1:
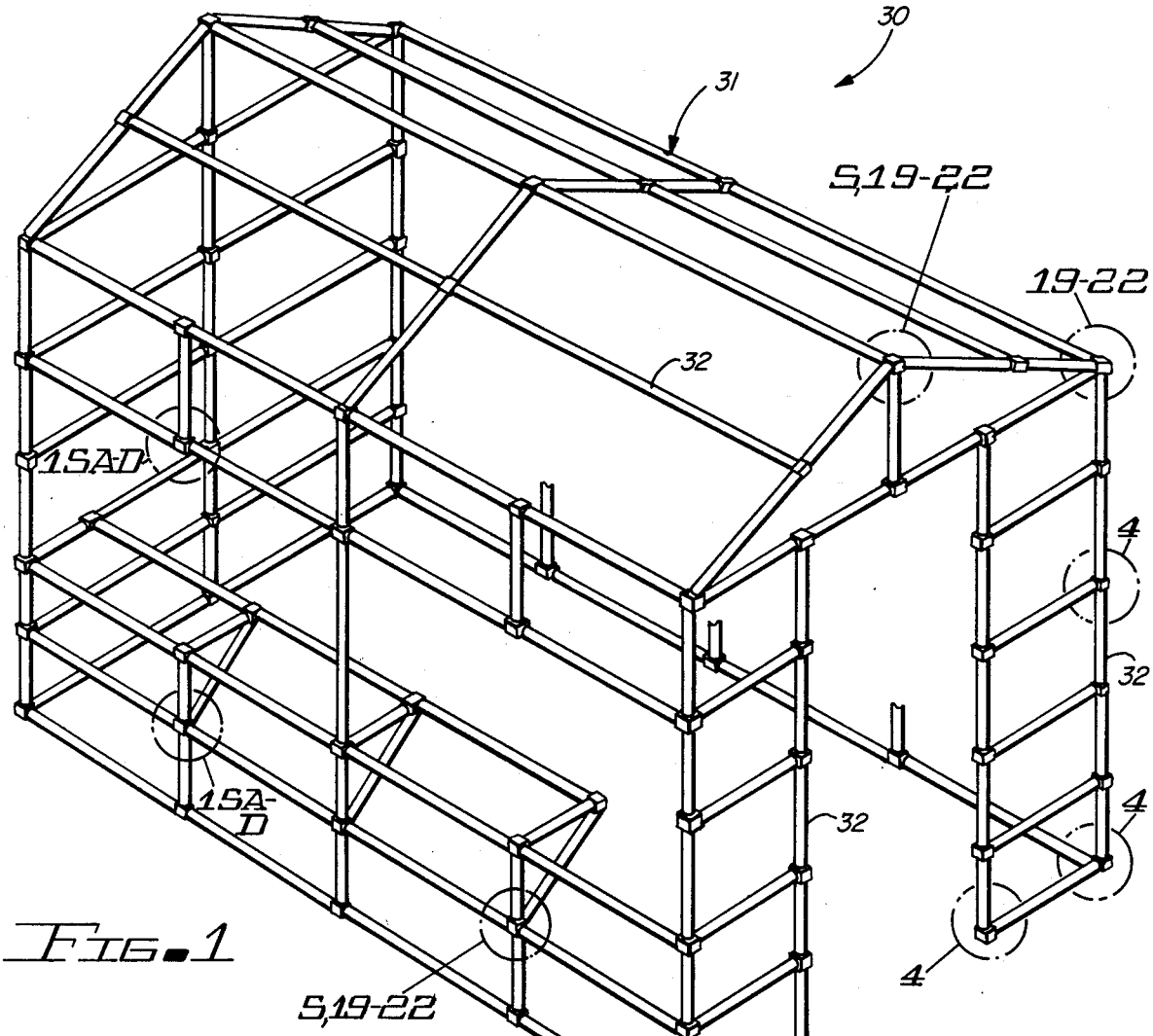
FIG. 1 is a perspective view of a space frame with the far side removed for purposes of clarity, the elongated members of which are interconnected by a plurality of different types of connector assemblies embodying the invention.

Referring more particularly to the drawings by characters of reference, FIG. 1 discloses, for purposes of illustration, a space frame 30 usable for two- and threedimensional framing systems formed of a plurality of homogeneous parts. Although a building is shown which may be a greenhouse, the framing system may be used to create many other types of architectural structures differing in size and shape, such as geodesic domes and space structures. Not only is the framing system usable for various building configurations, but it may be easily adapted for the creation of stair fixtures, display cabinets and cases, window frames, shelving components in a storage system, fixtures, such as hand rails, bathroom fixtures, and the like.

As shown in FIG. 1, framework 31 is formed of a plurality of tubular framing members 32 interconnected at various corners and joints by a plurality of connector assemblies forming joiner hubs and associated connector arms which are shown in the various figures of the drawings.

The joiner hubs comprise universal and fixed ball and socket connector arms which join one or more elongated members such as the tubular framing arms 32 together with the arms being capable of motion in all directions relative to the joint. Since the linkages of this invention permit 360 degrees of rotation of the connector arm assemblies relative to one another, it enables an almost unlimited variation of assemblages thereof.

Figures 2, 3, 3A, 4, 5, 5A, 6:
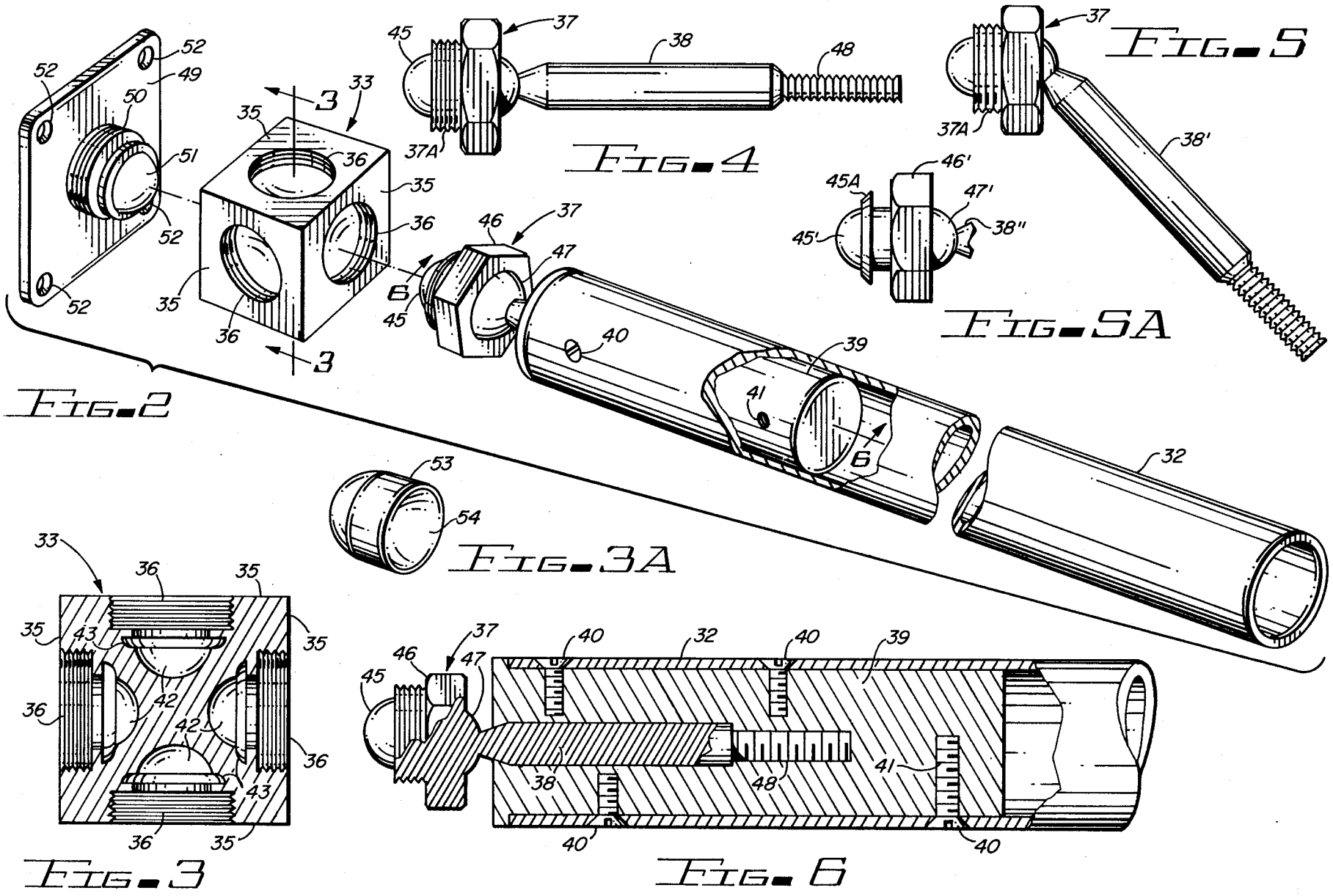
FIG. 2 is an exploded perspective view of one of the connectors and connector arm assemblies shown in FIG. 1.
FIG. 3 is a cross-sectional view of FIG. 2 taken along the line 3—3.
FIG. 3A is an enlarged perspective view of a bearing dish for a movable connector arm assembly.
FIG. 4 is an illustration of an immovable connector arm for use in the structure shown in FIG. 2.
FIG. 5 is a view of a modification of the immovable connector arm shown in FIG. 4 in a different arm extended position.
FIG. 5A is a modification of the socket connecting end of the connector arms shown in FIGS. 4 and 5 disclosing a snap-on connecting means.
FIG. 6 is a partial cross-sectional view of FIG. 2 taken along the line 6—6.

FIGS. 2–4 and 6 illustrate a basic connector 33 in this instance formed in the shape of a cube, having six faces 35 each having a socket 36 formed in its center. A fixed ball assembly 37 applied to one end of a connector arm 38 is threadedly connected to a male extension plug 39 although a suitable snap-on connection may be employed. Plug 39 is inserted in one end of tubular framing member 32 in the manner shown in FIG. 2 and held therein by connections, for example, set screws 40 extending through the connector arms into threaded holes 41 in plug 39, as shown in FIG. 6.

The fixed ball assembly 37 is adapted to threadedly engage or snap fit into socket 36 with its concave portion extending into a pocket or hole therein. The pocket 42 is in the shape of a partial sphere positioned at the end of each hole formed by the socket and is provided with an expansion ring or groove 43 extending outward of the inside periphery of the hole, in the manner shown in FIG. 3, to form an expansion ring groove for use with a connector arm employing an expansion flange around its ball-shaped configuration as hereinafter explained.

The fixed ball assembly, as shown in FIGS. 2 and 4, comprises a partial sphere 45 integrally formed with an externally threaded base 46 which is necked down to a spherical configuration or ball projection 47 formed at one end of connector arm 38. The other end of connector arm 38 is provided with an externally threaded shank 48 for threadedly engaging internally with the extension plug 39, as shown in FIG. 6. Although connector arm 38 is shown as being threadedly connected with extension plug 39, a friction or snap-on connection may be used and fall within the scope of this invention.

With either a threaded or snap-on connection, connector arm 38 is arranged to extend outwardly of connector 33 in a perpendicular direction from one of its faces 35.

As noted from FIG. 2, a mounting plate 49 having at least one externally threaded hub 50 extending laterally outwardly from one face thereof may be used to threadedly engage with its spherically shaped end 51 one of the sockets 36 in connector 33. Plate 49 may be secured to a base (not shown) by pin connections such as screws or bolts extending through holes 52 formed in each corner thereof.

Figures 17, 18, 19, 20, 21, 22:
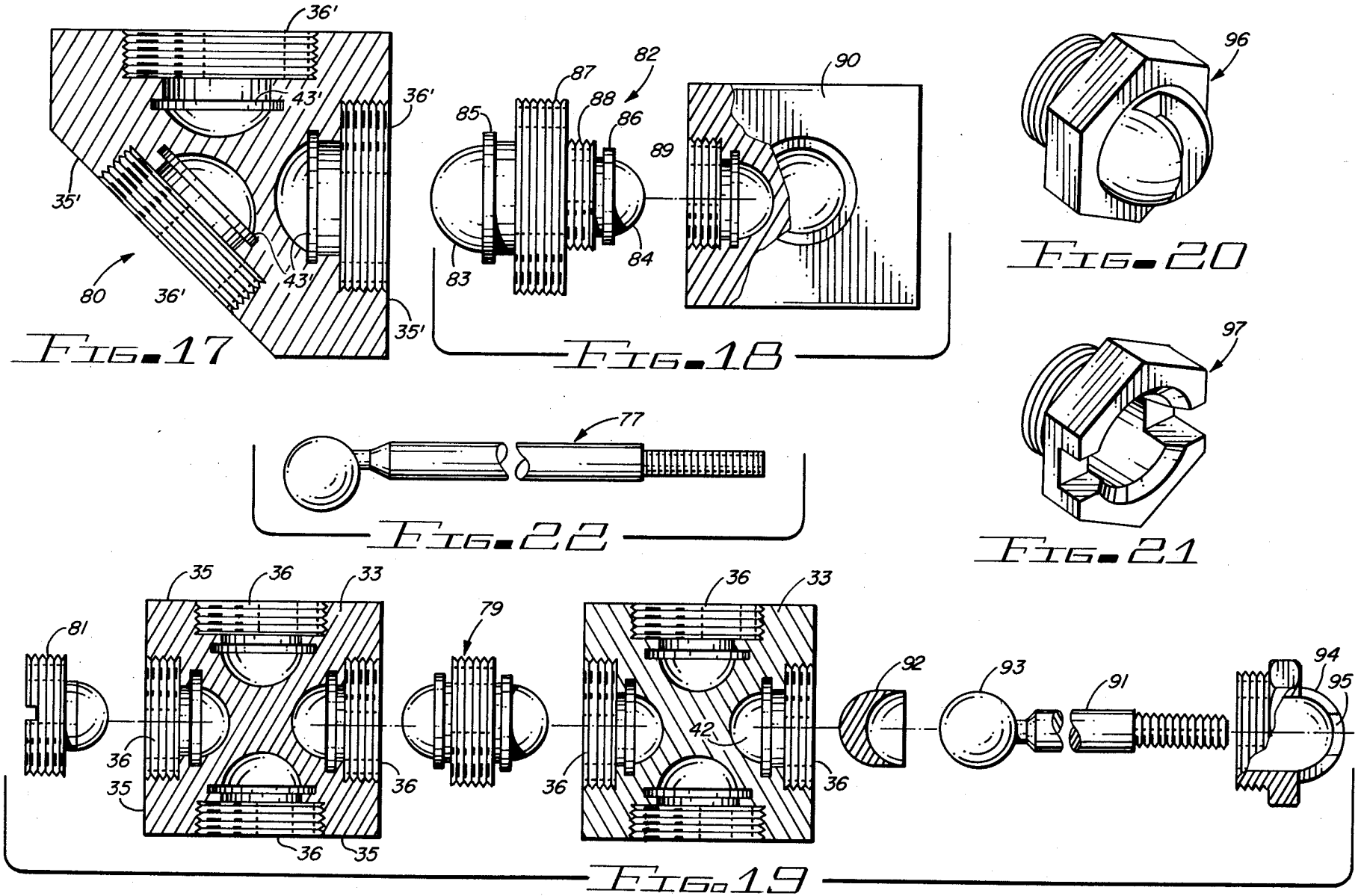
FIG. 17 is a cross-sectional view of FIG. 16 taken along the line 17—17.
FIG. 18 is an exploded view partly in section of an adaptor for use with the connector shown.
FIG. 19 is an exploded view of a pair of connectors interconnected by an adaptor that, for example, is shown connected with a movable connector arm assembly.
FIG. 20 is a perspective view of a modification of an anchor for use movable connector arms shown in FIG. 19.
FIG. 21 is a perspective view of a further modification of the anchors shown in FIGS. 19 and 20.
FIG. 22 is a plan view of a further modification of the connector arm shown in FIGS. 2, 4, 5 and 19.
Figures 29, 30:
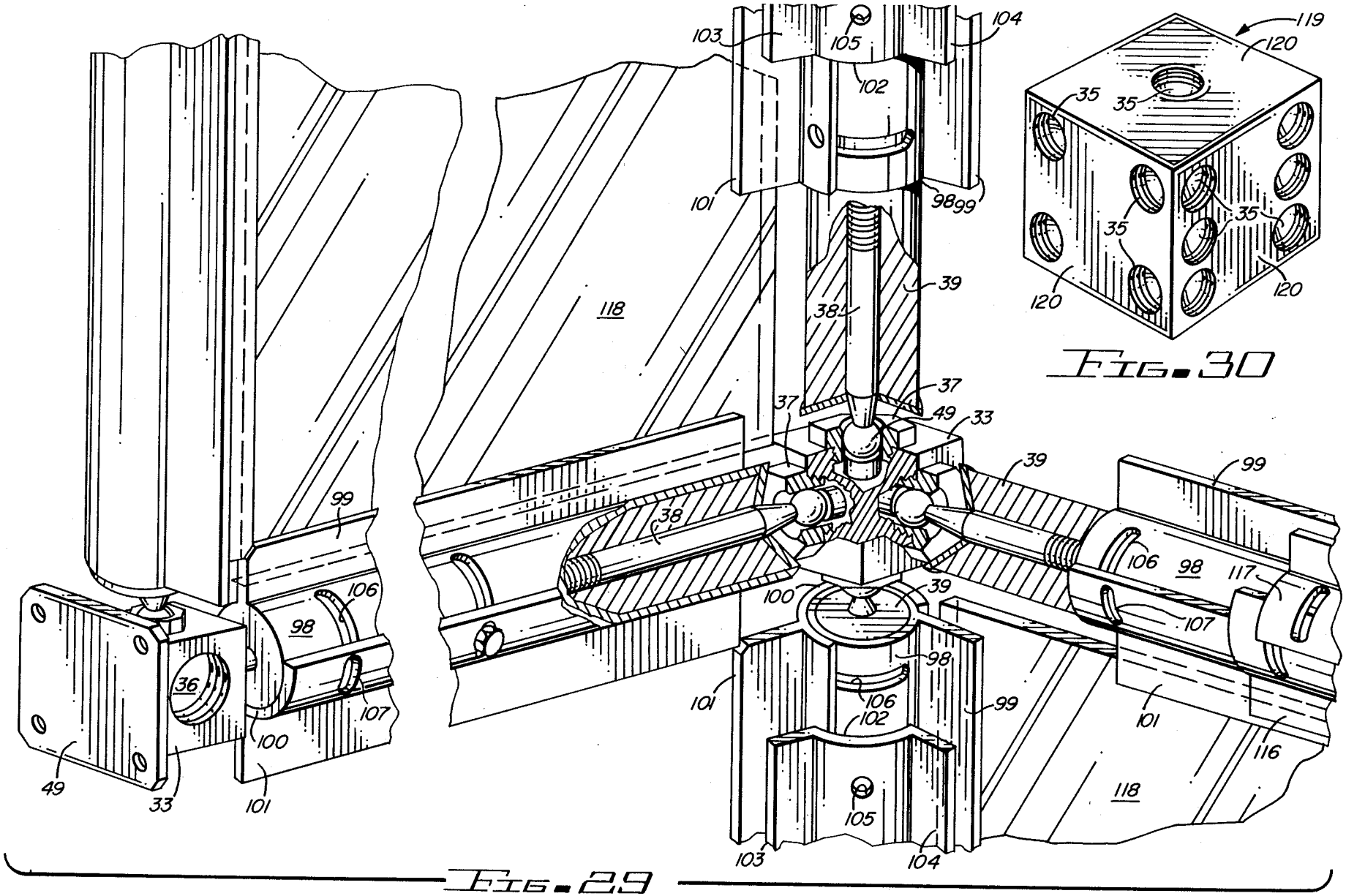
FIG. 29 is a partial perspective view partly in cross-section of a portion of a structure employing a pair of different connectors and various connector arm assemblies for use therewith, some being angularly adjustable and some being stationary.
FIG. 30 comprises a connector with some of its faces having more than one socket.

FIG. 3A illustrates an insert 53 forming a seat 54 that may be inserted into the open threaded end of a universal or movable ball assembly as shown in FIGS. 19 and 29.

FIG. 5 illustrates a modification of the connector arm 38 shown in FIGS. 2, 4 and 6 wherein connector arm 38' is rigidly formed with the fixed ball assembly 37 to extend outwardly thereof in a non-perpendicular arrangement.

FIG. 5A illustrates a modification of the connector arms 38 and 38' shown in FIGS. 4 and 5 wherein the connector arm 38'' comprises a partial sphere 45' integrally formed with a base 46' which is necked down to a spherical configuration of ball projection 47'. A flange 45A, formed of a suitable resilient material and of any suitable shape, is arranged around the periphery of the partial sphere 45', as shown, and tapered so as to move into the expansion grooves 43 of a connector such as connector 33, shown in FIGS. 2 and 3. Thus, the ball assemblies of the connector arms 38 and 38' may be fabricated without the threaded connecting means of FIGS. 2 and 3 and in place provided with the expansion ring 45A and make a "snap-on" connection with the interior of connector 33 and fall within the scope of this invention. This "snap-on" connection may be utilized by connector arm 38'' even though the interior of the sockets of connector 33 may be provided with the interior threads shown in FIG. 3. Thus, connector 33 may be used with both threaded and snap-on connector arms.

It should be noted that when the ball head of any of the connector arms disclosed, whether it be a threaded or snap-on connector arrangement, rests within the pocket 42, the spherical surface of the head engages the interior of the pocket forming a bearing surface for the spherical ends of spheres 45, 45', thus absorbing some of the forces on the arm otherwise applied only to its threaded or "snap-on" connecting means.

The "snap-on" connecting means, i.e., flange 45A and groove 43, may be used on the connector arms 38, 38' alone or in combination with its threaded connection 37A as shown by the combination of threaded connection and expansion flange arrangement on the adaptor plugs 79 and 82 of FIGS. 18 and 19.

In FIGS. 2 and 4, the male extension plug 39 is shown as being of a cylindrical configuration for connecting with a stretcher or tubular framing member 32.

FIGS. 7 and 7A illustrate a modification of this plug wherein extension plug 54 comprises a triangular configuration having a longitudinally extending, axially arranged bore 55 extending therein from its base plate end 56. Bore 55 is arranged for threadedly receiving therein the threaded end of one of the connector arms 38, 38'. As heretofore explained, bore 55 may be adapted to slidingly receiving and engaging in a snap-on arrangement the connector arms, if so desired.

The extension plug 54 is further provided with one or more spacedly-arranged threaded holes 57 for receiving therein pin connectors such as bolts (not shown) which clamp thereon a stretcher arm or tubular framing member 58 shown in FIG. 10. Framing member 58 is positioned on plug 54 in substantially the same manner as tubular framing member 32 telescopically or slidingly fits its associated male extension plug 39. Holes 59 in the tubular framing member 58 are used for receiving pins or bolts (not shown) for clamping the male plug and tubular framing member together.

FIG. 8 illustrates a further modification of the male extension plugs 39 and 54 shown in FIGS. 2, 6 and 7 wherein an extension plug 60 comprising a rectangular configuration having a square cross-sectional shape is telescopically or slidingly connected to a suitable tubular framing member in the manner shown in FIGS. 9, 11 and 12.

Extension plug 60 further comprises a base 61 having a bore 62 extending inwardly thereof along its axis a predetermined distance and having an internally threaded end 63 for receiving a threaded shank end 48 of a connector arm such as connector arm 38 of FIG. 4. A pair of internally threaded holes 64 are provided in one of the faces 65 of the extension plug 60 for threadedly receiving pin connections such as bolts extending through a suitable framing member telescopically or slidingly associated therewith in the same arrangement as described above for extension plugs 39 and 54. Other like holes may be formed in any of the other faces 65 of extension plug 60, if so desired.

Framing member 66 and 67 shown in FIGS. 9 and 11, respectively, may be bolted to one or more of the faces of extension plug 60 in the manner defined for the other extension plugs. FIG. 11 shows framing member 67 as comprising two members 67A and 67B which may be, for example, attached to opposite sides of extension plug 60.

FIGS. 12–14 illustrate further modifications of framing members for use with the extension plugs 54 and 60 of FIGS. 7 and 8. In FIG. 12, the framing member 68 comprises a platform 69 supported by a pair of diagonally-arranged legs 70, 71 with either the top or legs or both being provided with bolt holes 72 for using in securing the framing members to one of the male extension plugs 54 or 60 disclosed in FIGS. 7 and 8.

FIG. 13 discloses a framing member 73 which may be attached to extension plugs 54 and 60 by means of pin connections such as bolts extending through holes 74 for threadedly engaging with holes 57 and 64 in plugs 54 and 60, respectively.

FIG. 14 discloses a triangular shaped framing member 75 which may telescopically or slidingly receive therein extension plug 54 and be connected thereto by pins or bolts (not shown) extending through holes 76 selectively positioned therein.

FIGS. 15A—15D illustrate various ways the framing members shown in FIGS. 9–14 may be connected together.

Figure 15A:
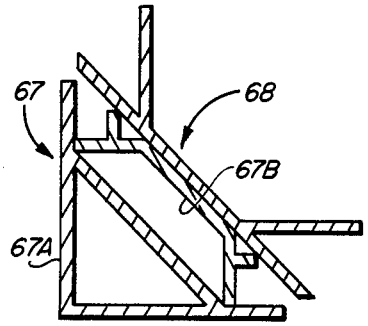
FIGS. 15A–15D are cross-sectional views of the tubular frame member in FIGS. 9–14.
Figure 15B:
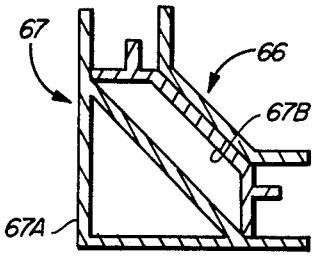
Figure 15D:
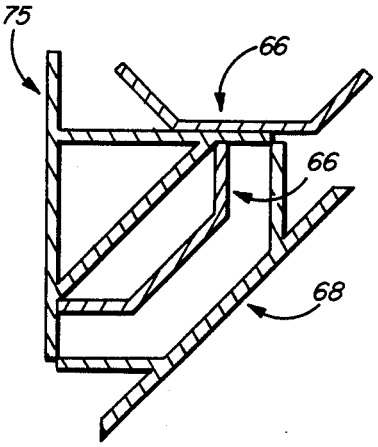
Figure 15C:
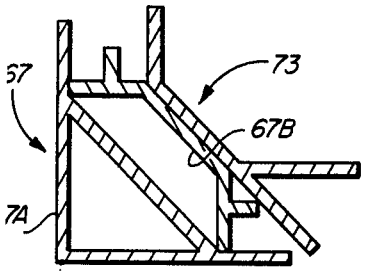

In FIG. 15A, the parts 67A and 67B of framing member 67 are secured to extension plug 68 in the manner shown. In FIG. 15B, the parts 67A and 67B of framing member 67 are secured to framing member 66. In FIG. 15C, the parts 67A and 67B of the framing member 67 are secured to framing member 73 and in FIG. 15D the framing members 66, 68 and 75 are secured together as shown.

Figure 16:
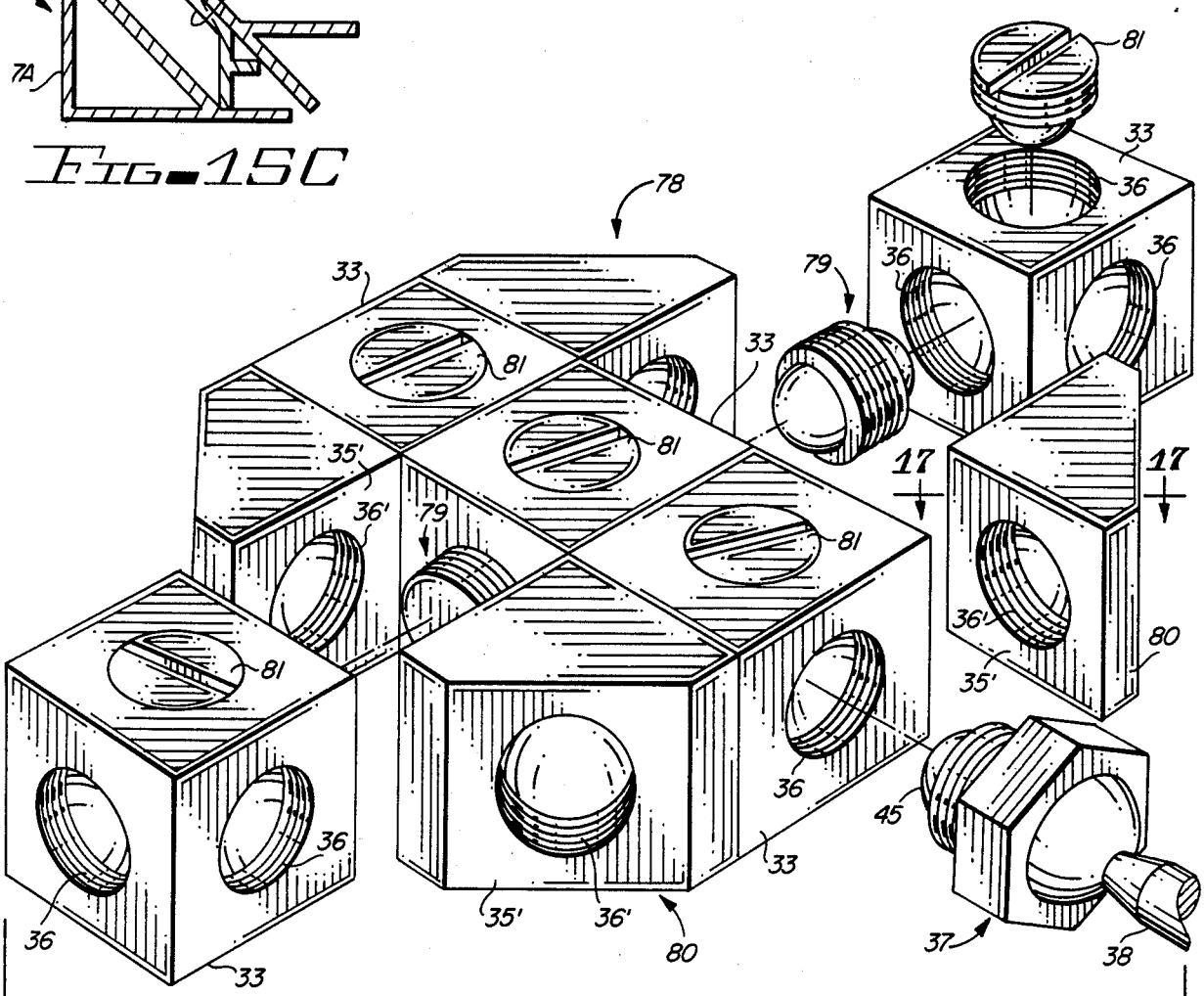
FIG. 16 is an exploded perspective view of combination of connectors and a partial view of a connector arm assembly embodying the invention.

FIG. 16 discloses a connector assembly 78 comprising a plurality of different geometrical configurations. As shown, a number of connectors 33 are interconnected by adaptor plugs 79 that are threadedly received by sockets 36 in juxtapositioned like connectors. It should be recognized that these plugs may on one or both ends be formed without the threaded configuration and in place thereof employ the expansion flange 45A of FIG. 5A. Thus, the flanges of the plugs would snap into grooves 43 in sockets 36 in the manner heretofore explained. These plugs make it possible to position like faces 35 of connectors 33 in coplanar touching arrangement.

As shown in FIGS. 16 and 17, a plurality of connectors 80 comprising a different geometrical configuration is provided with sockets 36' and expansion flanges 43' in its various faces 35' to connect with connectors 33 by means of plugs 79 to form, for example, an eight-sided connector 78.

Sockets 36 and 36' in the various connectors 33 and 80 may be used to receive and connect with ball assemblies 37 of various connector arm assemblies 38 and tubular framing members 32 in the manner heretofore defined.

The unused sockets of connectors 33 and 80 may be covered by a suitable cap 81 as shown in FIG. 16.

FIG. 18 illustrates a modification of adaptor plugs 29 wherein adaptor plug 82 comprising two hemispherical ends 83 and 84 each having expansion flanges 85 and 86 are interconnected by an externally threaded portion 87. The smaller hemispherical end 84 is provided with an externally threaded shank 88 for threadedly connecting with a socket 89 in a connector 90. The expansion flange 86 interlocks with the associated groove inside of the socket in connector 90 in the manner explained for connector 33. Connector 90 and its internally threaded socket 89 is smaller than connector 33 and its socket 36 and by means of plug 82 are used to interconnect structural elements of various sizes. As shown, the end 83 of plug 82 is provided with an expansion flange 88 for snap fitting into groove 43' of connector 80.

FIG. 19 is an exploded cross-sectional view of various parts of the disclosure illustrating one method of interconnection. A universal ball assembly 91 is shown connectably to one of the sockets 36 of a connector 33 by means of a bearing dish 92 which is inserted in the spherical opening 42 of the socket. Arm assembly 91 having a ball head 93 is held in the socket by pressure applied thereto by a cap 94 which threadedly engages with the internal threads of socket 36 or with the expansion ring groove if cap 94 is provided with a suitable expansion flange in the manner shown in FIG. 5A. Cap 94 loosely fits around ball head 93 with the remainder of arm assembly 91 extending outwardly thereof through an opening 95 formed in cap 94.

FIGS. 20 and 21 disclose anchors 96 and 97 which may be threadedly or snappingly attached to sockets 36 of connector 33 and used for interconnecting various universal ball assemblies to connector 33.

FIG. 22 discloses a plan view of a modified universal ball assembly 77 shown in FIGS. 19 and 29.

FIGS. 23–28 disclose cross-sectional views of various stretcher or tubular framing members for connecting with connector 33 in the manner shown in the illustrative structural assembly shown in FIG. 29.

Figure 23:
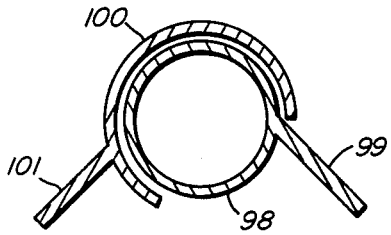

FIG. 23 illustrates a cylindrical configuration 98 having a flange 99 extending outwardly thereof for mounting around extension plug 39. A second open cylindrical configuration 100 having a flange 101 extending outwardly thereof is arranged in a limited rotating manner around the outer periphery of the cylindrical configuration 98.

An arcuate cleat 102 having flanges 103 and 104 extending outwardly thereof is arranged to be bolted to plug 39 between flanges 99 and 101 of the cylindrical configurations 98 and 100 by a pin connection or bolt extending through hole 105 into plug 39 to hold them in a fixed or movable orientation, as shown in FIG. 29. As shown in FIG. 29, the cylindrical configuration 98 may be provided with a slot 106 extending partially around its periphery for permitting a pin connection or bolt extending through hole 105 in cleat 102 to reach plug 39 and/or to be used to lock the cylindrical configurations 98 and 100 together.

Figure 25:
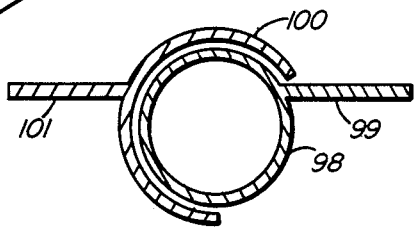
Figure 24:
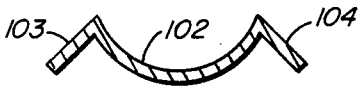

FIG. 25 illustrates a different relative portion of the cylindrical configurations 98 and 100 held together by a pin connection bolt (not shown) extending through slots 106 and 107 into plug 39 without the benefit of cleat 102.

FIG. 26 illustrates the manner of slidingly receiving two elongated arcuate configurations 108 and 109 which may be bolted to plug 39 in the manner heretofore described to hold these members together to form framing members or cleats for the space frame.

Figure 27:
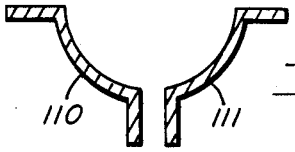
Figure 25:
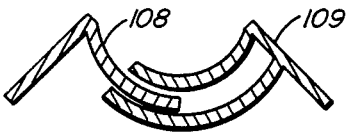

FIG. 27 illustrates a cross-sectional view of a further modification of the framing members or cleats wherein two arcuate protions 110 and 111 are shown which may be bolted to plug 39 in any desirable arrangement.

Figure 28:
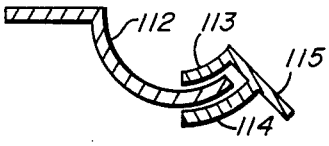

FIG. 28 illustrates a cross-sectional view of a further modification of the framing members or cleats wherein an arcuate portion 112 fits between a pair of cooperating arms 113 and 114 of a further arcuate portion 115 in the manner shown.

FIG. 29 further illustrates that two cleats 116 and 117 may be fastened to plug 39 by pin connections or bolts (not shown) extending through their slots 118 and 119 to hold cylindrical configurations 98 and 100 in given relative positions.

As shown in FIG. 29, suitable panels 118 may be secured to the various flanges of the stretcher arms or framing members to complete a building or building module.

Although the connectors 33 are shown as having only one socket 36 per face, it should be recognized that more than one socket may be used in each face as shown in FIG. 30 and still fall within the scope of this invention.

FIG. 30 comprises a further modification of connector 33 wherein a cubical configuration 119 is shown having one or more socket 36 formed in one or all of its faces 120. For purposes of illustration, one socket 35 is shown in its top surface and more than one socket 35 is shown in the two sides shown. Each of the sockets is arranged to receive in the manner discussed one of the connector arm assemblies disclosed.

Although but a few embodiments of the present invention have been illustrated and described, it will be apparent to those skilled in the art that various changes and modifications may be made therein without departing from the spirit of the invention or from the scope of the appended claims.

What is claimed is:

1. A connector assembly for space framing systems comprising:

a first multi-face body having at least one socket-type connection means in one of said faces, said socket-type connecting means comprising an opening with at least a part of said connecting means being provided with a first means for independently connecting with an associated connector arm, said first means comprising a machine thread, at least one relatively angularly disposed connector arm connected to and radiating from said one of said socket-type connecting means, said connector arm having a spherical terminal male portion, the external dimensions of which fit into said one opening and an anchor nut portion which connects with said first means of said socket-type connecting means, said connector arm comprising a second means for forming a shank for connecting with a framing arm of a framing system, and a plug having an internal bore within which the shank of said connector arm is connected.

2. The connector assembly set forth in claim 1 wherein:

said plug comprises a cylindrical configuration.

3. The connector assembly set forth in claim 1 wherein:

said plug comprises a triangular configuration.

4. The connector assembly set forth in claim 1 wherein:

said plug comprises a rectangular configuration having a square cross section.

5. A connector assembly for space framing systems comprising:

a first multi-face body having at least one socket-type connection means in one of said faces, said socket-type connecting means comprising an opening at least a part of which is provided with internal means for connecting with an associated connector arm, at least one relatively angularly disposed connector arm connected in and radiating from said one of said socket-type connecting means, said connector arm having a spherical terminal male portion, the external dimensions of which fit into said one opening and connects with said internal means of said socket-type connecting means, said connector arm comprising a second means for connecting with a framing arm of a framing system, a second multi-face body having at least one socket-type connecting means in one of said faces, and a two-ended adaptor plug, each end of which engages a socket-type connecting means in a different multi-face body for connecting the multi-face bodies in an integral juxtaposition arrangement, the socket-type connecting means in said second multi-face body being of a different size than said socket-type connecting means in said first multi-face body.

6. The connector assembly set forth in claim 5 wherein:

the socket-type connecting means in said second multi-face body is of a smaller size than said socket-type connecting means in said first multi-face body.

* * * * *